US005801613A

United States Patent [19]

Takahashi

[11] Patent Number: 5,801,613

[45] Date of Patent: Sep. 1, 1998

[54] LINEAR MOTION ELECTRIC COMPONENT WITH SCREW-ACTUATED WIPER

[75] Inventor: Kisaburo Takahashi, Miyagi-ken, Japan

[73] Assignee: Alps Electric Co., Ltd., Japan

[21] Appl. No.: 799,561

[22] Filed: Feb. 10, 1997

[30] Foreign Application Priority Data

Feb. 16, 1996 [JP] Japan ..... 8-053807
Dec. 18, 1996 [JP] Japan ..... 8-354160

[51] Int. Cl.[6] ..... H01C 10/40

[52] U.S. Cl. ..... 338/180; 338/180; 338/176

[58] Field of Search ..... 338/22 R, 22 SD, 338/180; 427/102

[56] References Cited

U.S. PATENT DOCUMENTS 4,270,394 6/1981 Ito et al. ..... 74/10 R
4,824,694 4/1989 Bosze et al. ..... 427/102
5,433,691 7/1995 Hiroka et al. ..... 492/45

FOREIGN PATENT DOCUMENTS 5-52765 8/1993 Japan .

*Primary Examiner*—Renee S. Luebke
*Assistant Examiner*—Jeffrey Pwu
*Attorney, Agent, or Firm*—Brinks Hofer Gilson & Lione

[57] ABSTRACT

A linear motion electric component with screw-actuated wiper is disclosed with a shaft member having a shaft portion of synthetic resin formed on an end of a metal pipe shaft. The shaft portion is fitted in a bearing portion, thereby insuring smooth rotation of the shaft member with low cost.

11 Claims, 2 Drawing Sheets

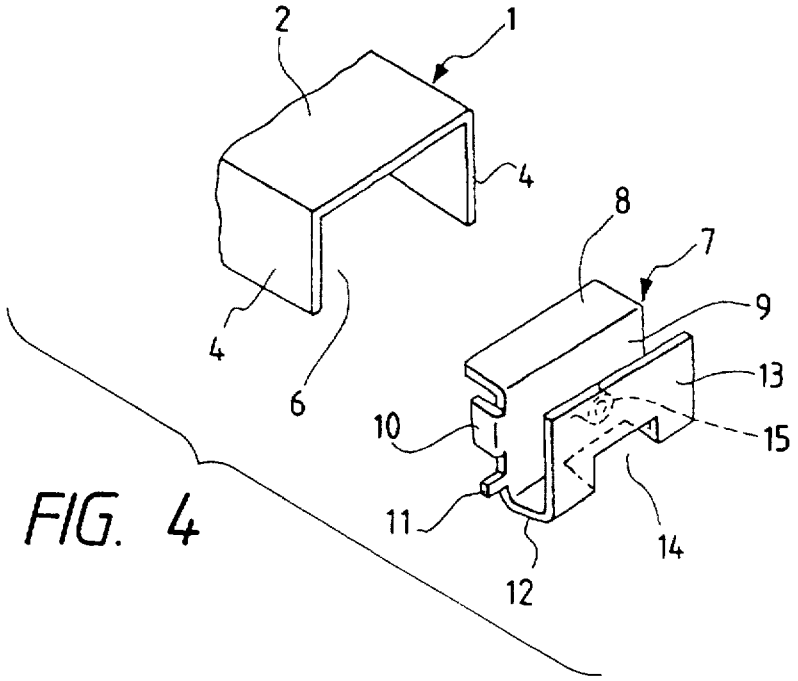
FIG. 4
FIG. 5
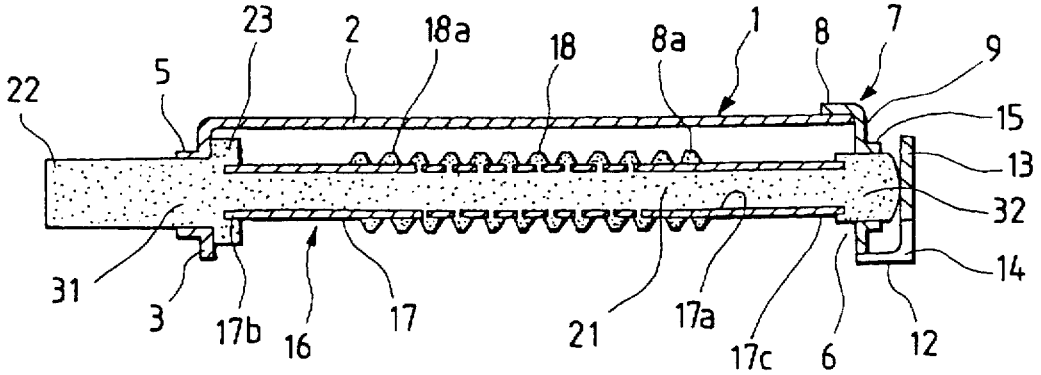
FIG. 6 PRIOR ART
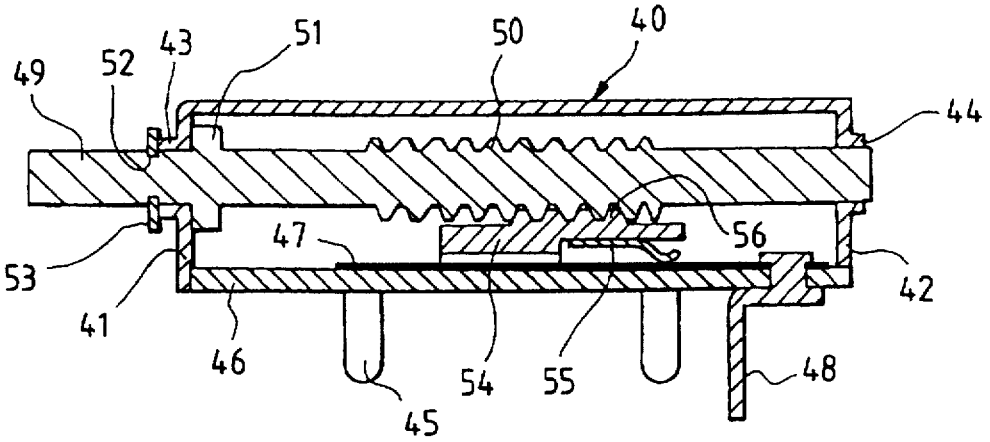

LINEAR MOTION ELECTRIC COMPONENT WITH SCREW-ACTUATED WIPER

BACKGROUND OF THE INVENTION

1. Field of the Invention

The present invention relates to an electrical component such as a variable resistor and a switch used in audio equipment, office machinery, or the like.

2. Description of the Related Art

An electrical component, for instance a variable resistor, used in auto equipment or the like has bearing portions 43 and 44 in opposite side plates 41 and 42 of a box-type frame 40 made of metal or the like as shown in FIG. 6.

In the opening section of the frame 40 an insulating substrate 46 is fixedly attached by attaching legs 45 of the frame 40. On this insulating substrate 46 a resistor 47 is formed. The resistor 47 is so constructed as to be electrically led out by means of a terminal 48 secured on the insulating substrate 46.

A shaft 49 rotatably mounted between the bearing portions 43 and 44 is uniformly made of metal or synthetic resin. This shaft 49 is provided with a thread portion 50, a collar portion 51, and a groove portion 52. In the groove portion 52 located outside of the frame 40, a washer 53 having resilience is fitted to thereby keep the collar portion 51 in contact with the side plate 41 of the frame 40 to limit the axial movement of the shaft 49.

A movable member 54 produced of synthetic resin is fitted with a metal slider 55 for sliding on the resistor 47. The movable member 54 has a thread portion 56 in mesh with the thread portion 50 of the shaft 49. With the rotation of the shaft 49, the movable member 54 in mesh with the thread portion 50 is moved in the axial direction. As the movable member 54 moves, the slider 55 slides on the resistor 47 in the axial direction, thereby adjusting the value of resistance.

Prior to the assembling of the shaft 49 to the frame 40 in such an electrical component, the frame 40 is prepared with the rear side plate 42 slightly inclined outwardly.

In this state, first the shaft 49 on the collar portion 51 side is inserted into the bearing portion 43, and then with the other end of the shaft 49 set oppositely to the rear bearing portion 44, the side plate 42 is bent and the shaft 49 is inserted into the bearing portion 44.

Thereafter the washer 53 is fitted in the groove portion 52 of the shaft: 49, thus completing assembling.

That is, the shaft 49 of the conventional electrical component is uniformly made of metal or synthetic resin, and has the following problems. The metal shaft 49 is not in a superior contacted state with the bearing portions 43 and 44 of the frame 40. This prevents the shaft 49 from rotating smoothly with respect to the bearing portions 43 and 44 and causes squeaking. Moreover the thread portion 50 needs a large amount of time and labor for its processing, raising the cost of the shaft 49. On the other hand, the synthetic resin shaft 49 is subject to substantial changes in its dimensions due to thermal expansion or aging (i.e., elapse of time), largely affecting its portion in contact with the bearing portions 43 and 44. Under such a condition the shaft 49 is likely to bend, resulting in unsmooth rotation.

Furthermore, the conventional electrical component not only needs the washer 53 in assembling the shaft 49 to the frame 40 but needs bending the rear side plate 42; this will increase the number of component parts and the number of assembling processes, resulting in an increased cost.

SUMMARY OF THE INVENTION

It is, therefore, an object of the present invention to provide a low-cost electrical component which can smoothly rotate.

As a first aspect for solving the aforesaid problems, a shaft member is constructed by forming a shaft portion of synthetic resin on the end portion of a metal pipe shaft and by fitting the shaft portion in a bearing portion.

As a second aspect, the synthetic resin shaft portion is formed on the outer periphery of the pipe shaft.

As a third aspect, the synthetic resin shaft portion is formed on either end of the pipe shaft.

As a fourth aspect, the synthetic resin shaft formed on either end of the pipe shaft is connected with a synthetic resin connecting portion formed within the hollow section of the shaft.

As a fifth aspect, a synthetic resin thread portion connected to the synthetic resin connecting portion is formed on the outer periphery of the pipe shaft.

As a sixth aspect, a synthetic resin thread portion connected to the synthetic resin connecting portion formed within the hollow section of the shaft is formed on the outer periphery of the metal pipe shaft, and axially movable synthetic resin threads are formed on at least one end of the thread portion.

Furthermore, as a seventh aspect the electrical component is provided with a plate section having a bearing portion, and a mounting member connected to the plate section and having a pressing section located oppositely to the bearing portion; the plate section is attached to the frame, and a shaft member inserted in the bearing portion is pressed by the pressing section.

The foregoing objects and other objects will become more apparent and understandable from the following detailed description thereof, when read in connection with the accompanying drawings.

BRIEF DESCRIPTION OF THE DRAWINGS

FIG. 4 is a perspective view for explaining a mounting member in the electrical component according to the present invention;

FIG. 5 is a sectional view showing another embodiment of the electrical component according to the present invention; and FIG. 6 is a sectional view of a major portion of a conventional electrical component.

DESCRIPTION OF THE PREFERRED EMBODIMENTS

Figure 1:
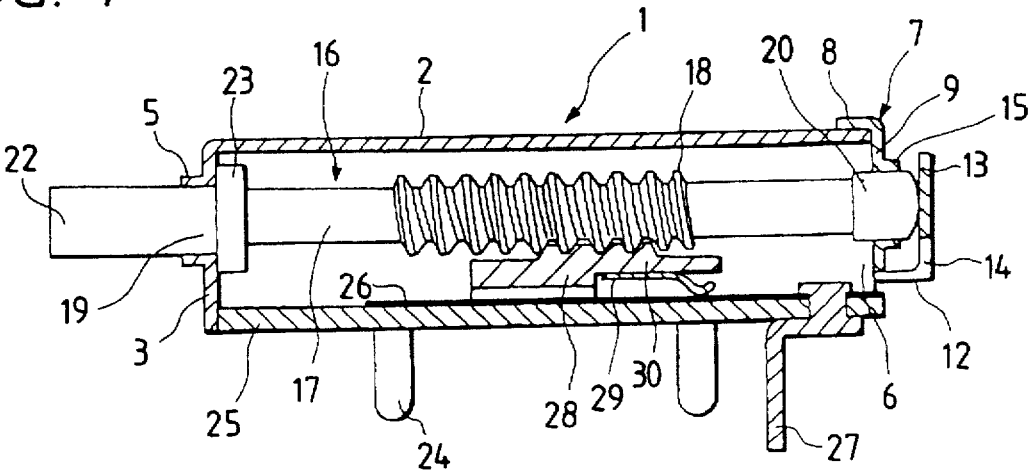
FIG. 1 is a sectional view of a major portion of an electrical component according to the present invention.
Figure 2:
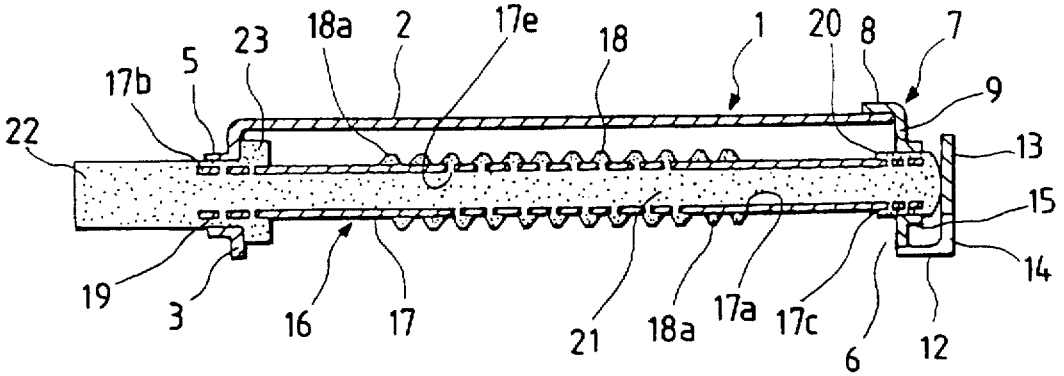
FIG. 2 is a partially sectional view of the electrical component according to the present invention.

Next, an electrical component, for example a variable resistor, of the present invention will be described with reference to FIGS. 1 to 4.

A virtually box-type frame 1 formed of metal has a top plate 2, a front plate 3 and side plates 4, which are formed in one body. In the front plate 3 a cylindrical bearing portion 5 is formed; and an opening section 6 is provided at the rear of the frame 1 facing the front plate 3.

A mounting member 7 formed by bending a metal plate, as shown in FIG., 4, is comprised of a mounting section 8 positioned in the upper part, a plate section 9 bent at a right angle in relation to the mounting section 8, a mounting section 10 bent in the same direction as the mounting section 8 in relation to the plate section 9, a projection 11 protruding from the plate section 9 toward the plate surface, a pressing section 13 formed via a connecting member 12 so as to face the plate section 9, a cutout 14 for giving great resilience to the pressing section 13, and a bearing portion 15 provided in the plate section 9 in a position facing the pressing section 13.

The mounting member 7 is attached by spot welding or staking to the frame 1 in the opening section 6, with the mounting section 8 placed on the top plate 2 of the frame 1, the other mounting section 10 positioned within the frame 1, extending over the side plate 4, and the projection 11 held in contact with the end face of the side plate 4.

A shaft member 16 mounted across the bearing portion 5 of the frame 1 and the bearing portion 15 of the mounting member 7 comprises: a cylindrical metal pipe shaft 17 having a hollow section 17*a*; a thread portion 18 of synthetic resin formed on the outer periphery of the shaft 17; shaft portions 19 and 20 of synthetic resin formed so as to cover the outer periphery of the shaft 17 at its both ends 17*b* and 17*c*; a connecting portion 21 of synthetic resin filled in the hollow section 17*a* of the shaft 17, for connecting the thread portion 18 with the shaft portions 19 and 20; an operating portion 22 formed integrally with the connecting portion 21; and a collar portion 23 of synthetic resin formed on the outer periphery of the shaft 17 and connected to the connecting portion 21.

Figure 3:
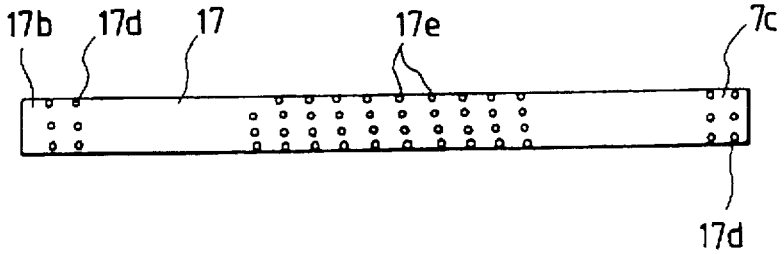
FIG. 3 is a side view of a shaft used in the electrical component according to the present invention.

The shaft member 16 having the above-described constitution, as shown in FIG. 3, has a plurality of holes 17*d* communicating to the hollow section 17*a* at the both ends 17*b* and 17*c* of the shaft 17, and a plurality holes 17*e* communicating with the hollow section 17*a*, made in a spiral form at the center section, correspondingly to the spiral thread portion 18. The shaft member 16 of the aforesaid constitution is produced by insert-molding of synthetic resin in the shaft 17. The thread portion 18, shaft portions 19 and 20, and collar portion 23 of the shaft member 16 thus made are connected integrally with the connecting portion 21 in the hollow section 17*a* via the holes 17*d* and 17*e*.

Therefore, it is possible to manufacture the shaft member accurately and at a low cost as compared with that of a molding compound or a metallic material.

Also, in the thread portion 18 formed of synthetic resin formed on the outer periphery of the shaft 17, several turns of threads 18*a* formed on both ends thereof are formed on portions where no holes 17*e* of the shaft 17 are present. The threads 18*a* are designed to be movable on the outer periphery of the shaft 17 in the direction of contraction between the threads 18*a*, that is, in the axial direction of the shaft 17, with resilience of the synthetic resin.

The shaft member 16 is so constructed that the shaft portion 19 is disposed in the bearing portion 5 of the frame 1 and further that the other shaft portion 20 is positioned in the bearing portion 15 of the mounting member 7. The shaft portions 19 and 20 of synthetic resin contact with the bearing portions 5 and 15 respectively. The pressing section 13 of the mounting member 7 pushes the rear end of the shaft member 16, which in turn presses the collar portion 23 against the front plate 3 to thereby restrict vibration of the shaft member 16.

To install the shaft member 16 to the frame 1, first the operation portion 22 is inserted into the bearing portion 5 of the frame 1, then, with the shaft portion 20 inserted into the bearing portion 15 of the mounting member 7, the mounting member 7 is positioned in the opening section 6 of the frame 1. Finally the mounting member 7 is installed to the frame 1, thus completing the installing procedure.

On the frame 1 an insulating substrate 25 is fixedly attached by mounting legs 24. On this insulating substrate 25 a resistor 26 is formed. The resistor 26 is so designed as to be electrically led out by means of a terminal 27 which is secured on the insulating substrate 25.

A movable member 28 made of synthetic resin housed within the frame 1 is fitted with a metal slider 29 for sliding on the resistor 26; the movable member 28 is provided with a thread portion 30 which is engaged with the thread portion 18 provided on the shaft member 16. With the rotation of the operating portion 22, the movable member 28 engaged with the thread portion 18 is axially moved, and with the movement of this movable member 28, the slider 29 axially moves on the resistor 26, thereby adjusting the value of resistance.

When the movable member 28 hits against the plate section 9 or the collar portion 23, further movement of the movable member 28 is stopped. At this time only the threads 18*a* movable on the outer periphery are in mesh with the threads 30; when the rotation of the shaft member 16 is continued, the threads 18*a* formed on the end portions of the thread portion 18 move in the direction of the shaft 17, along the thread portion 30 of the movable member 28, in which the pitch of the threads 18*a* contracts, finally demeshing from the thread portion 30 to allow the shaft member 16 to rotate idle.

At this time, since the pitch of the threads 18*a* is in a contracted stated, the threads 18*a* receive the spring pressure in the direction of the shaft 17, thus pressing the movable member 28 against the plate section 9 or the collar portion 23.

Next, when the shaft member 16 in this state is rotated in the opposite direction of rotation (from the clockwise direction to the counterclockwise direction, or from the counterclockwise direction to the clockwise direction), the threads 18*a* come into mesh with the thread portion 30 by the resilience of the threads 18*a* contracted. Thereafter the movable member 28 moves along the thread portion 18.

FIG. 5 shows another embodiment of the shaft member in the electrical component of the present invention, in which shaft portions 31 and 32 of synthetic resin are formed, protruding from the respective ends of the shaft 17, at ends 19 and 20 of the metal pipe shaft, and the shaft portions 31 and 32 are fitted in the bearing portions 5 and 15 respectively. The constitution of the other members is similar to the above-described embodiment; therefore the like members are designated by the like reference numerals, and will not be described.

It is to be noticed that one shaft portion may be formed of only synthetic resin and the other shaft portion, of a metal pipe around which a synthetic resin pipe is added as previously described.

In the present invention, as has been described, the shaft member is constructed by forming shaft portions of synthetic resin at the ends of a metal pipe shaft, and the shaft portions are fitted to the bearing portions. Therefore the synthetic resin shaft slides in the bearing portion, producing no such squeak as is experienced in a conventional metal shaft. The shaft easily gets run in with the bearing portion, assuring smooth shaft member rotation. Also the use of the metal pipe shaft, unlike conventional synthetic resin shafts, can prevent substantial changes in the dimensions of the shaft portion due to thermal expansion or aging (i.e., elapse of time). It is, therefore, possible to provide an electrical component that can reduce a change in the axial center of the shaft member, thereby insuring smooth rotation of the shaft member.

Furthermore, since the synthetic resin shaft portion is added to the outer periphery of the metal pipe shaft, a change likely to be caused by the thermal expansion of the shaft portion can be substantially decreased, whereby a shaft member of good concentricity is obtainable to insure smoother rotation.

Furthermore, synthetic resin shaft portions are formed on both ends of the metal pipe shaft; the both ends being connected by a synthetic resin connecting portion formed within the hollow section of the shaft; and at the same time a thread portion formed on the outer periphery of the shaft communicating with the connecting portion, thus obtaining a strength for mounting the shaft and the thread portion to the shaft. Besides, because the connecting portion is formed by utilizing the interior of the hollow section, a good space factor is gained, and moreover the use of the metal pipe shaft enables the molding of precision shaft and thread portions of synthetic resin.

Furthermore, since synthetic resin threads movable in the axial direction are formed on at least one end of the synthetic resin thread portion, the movable member is elastically pressed by the axial resilience of the threads itself to thereby enable idling of the shaft. Therefore it is possible to provide a low-cost electrical component that can easily be assembled without any other parts needed for pressing the movable member located at the end.

Furthermore, since there are formed threads movable to portions having no holes communicating with the hollow section of the shaft, the threads can smoothly move in the axial direction on the outer periphery of the shaft, enabling smooth movement with idling.

Furthermore, because of the use of a mounting member having a plate section with a bearing portion, and a pressing portion, it is possible to provide a low-cost, easy-to-assemble electrical component comprising a few number of component parts in which the mounting member serves as a pressing member for the frame and the shaft member.

What is claimed is:

1. A linear motion electric component with a screw-actuated wiper comprising:

a shaft member having a hollow metal pipe part on which a plurality of holes are arranged along an axial direction of said shaft, helical screw threads of resin formed along said axial direction at an outer circumference of said metal pipe part and a connecting part connecting, via said holes, said screw threads within said hollow metal pipe part;

bearing portions in which said shaft member is fitted and said shaft member is rotatably held; and a movable member having a slider arranged therein, engaged with said screw part and movable in an axial direction, which is parallel to said linear motion.

2. A linear motion electric component with a screw-actuated wiper according to claim 1, wherein a space between the resin screw threads is formed with the metal pipe part being exposed.

3. A linear motion electric component with a screw-actuated wiper according to claim 1, wherein it is comprised of a thread portion of synthetic resin connected to a connecting portion of synthetic resin formed within the hollow section of a metal pipe part on the outer periphery of said pipe part; and axially movable threads of synthetic resin formed on at least one end of said thread portion.

4. A linear motion electric component with a screw-actuated wiper according to claim 3, wherein said metal pipe part comprises a portion formed with holes communicating with said hollow section of said metal pipe part, and wherein said axially movable threads of synthetic resin are formed by several turns in portions having no hole communicating with said hollow section of said metal pipe part.

5. A linear motion electric component with a screw-actuated wiper according to claim 1, wherein an end part of said metal pipe part is formed with a shaft portion of synthetic resin connected to said connecting part and said shaft portion is fitted in the bearing portions.

6. A linear motion electric component with a screw-actuated wiper according to claim 5, wherein said shaft member is constituted by forming said shaft portions of synthetic resin on both ends of said metal pipe part.

7. A linear motion electric component with a screw-actuated wiper according to claim 5, wherein said shaft member is constituted by forming said shaft portion of synthetic resin on the outer periphery of said metal pipe part.

8. A linear motion electric component with a screw-actuated wiper according to claim 7, wherein said shaft member is constituted by forming said shaft portions of synthetic resin on both ends of said metal pipe part.

9. A linear motion electric component with a screw-actuated wiper comprising:

a shaft member in which helical screw threads are formed along an axial direction;

a movable member having a slider arranged therein, engaged with said screw part and movable in an axial direction, which is parallel to said linear motion;

a frame forming an outer shell, storing a slider and having a bearing portion holding one end of the shaft member; and a pressing member having a plate section to fit the other end of said shaft member and having a bearing for rotatable holdings said shaft member and a pressing section connected to said plate section and oppositely facing against said bearing portion, wherein said plate section is fixed to the frame and the shaft member inserted into and passed through said bearing portion is pushed at the pressing section in an axial direction.

10. A linear motion electric component with a screw-actuated wiper according to claim 9, wherein the end surface of the shaft member is biased by the pressing member and pushed in an axial direction.

11. A linear motion electric component with a protrusion-actuated wiper comprising;

a shaft member having a hollow metal pipe part on which a plurality of holes are arranged along an axial direction of said shaft, a resin protrusion formed along said axial direction at an outer circumference of said metal pipe part and a connecting part connecting, via said holes, said resin protrusion within said hollow metal pipe part;

bearing portions in which said shaft member is fitted and said shaft member is rotatably held; and a movable member having a slider arranged therein, engaged with said resin protrusion and movable in an axial direction, which is parallel to said linear motion.

* * * * *

UNITED STATES PATENT AND TRADEMARK OFFICE

CERTIFICATE OF CORRECTION

PATENT NO. : 5,801,613

DATED : September 1, 1998

INVENTOR(S) : Kisaburo Takahashi

It is certified that error appears in the above-indentified patent and that said Letters Patent is hereby corrected as shown below:

In claim 9, line 13, replace "rotatable holdings" with --rotatably holding--.

Signed and Sealed this

Twelfth Day of January, 1999

*Attest:*

*Attesting Officer*

*Acting Commissioner of Patents and Trademarks*